US010482741B2

(12) United States Patent
Horon

(10) Patent No.: US 10,482,741 B2
(45) Date of Patent: Nov. 19, 2019

(54) MULTI-FRAME DISPLAY FOR A FIRE PROTECTION AND SECURITY MONITORING SYSTEM

(71) Applicant: Daniel J. Horon, Minneapolis, MN (US)

(72) Inventor: Daniel J. Horon, Minneapolis, MN (US)

( * ) Notice: Subject to any disclaimer, the term of this patent is extended or adjusted under 35 U.S.C. 154(b) by 0 days.

(21) Appl. No.: 15/477,985

(22) Filed: Apr. 3, 2017

(65) Prior Publication Data

US 2017/0287298 A1 Oct. 5, 2017

Related U.S. Application Data

(60) Provisional application No. 62/316,976, filed on Apr. 1, 2016.

(51) Int. Cl.
*G08B 19/00* (2006.01)
*G08B 13/196* (2006.01)

(52) U.S. Cl.
CPC ..... *G08B 19/005* (2013.01); *G08B 13/19645* (2013.01); *G08B 13/19652* (2013.01); *G08B 13/19671* (2013.01)

(58) Field of Classification Search
CPC ..... G08B 19/005; G08B 13/19645; G08B 13/19652; G08B 13/19671; H04L 41/14; H04L 41/22; H04L 43/045; H04L 67/22; H04L 67/36
See application file for complete search history.

(56) References Cited

U.S. PATENT DOCUMENTS 6,665,004 B1 * 12/2003 Paff ..... G08B 13/19645 348/156
6,690,274 B1 * 2/2004 Bristol ..... G05B 23/0267 340/506
6,972,676 B1 * 12/2005 Kimmel ..... G08B 13/19608 340/3.1
7,137,074 B1 * 11/2006 Newton ..... G06F 11/0748 715/835
7,149,975 B1 * 12/2006 Johnson ..... H04L 41/22 715/734
7,380,210 B2 * 5/2008 Lontka ..... G08B 25/14 340/286.05
8,171,426 B2 * 5/2012 Loverin ..... G06F 3/0481 715/206
8,269,620 B2 * 9/2012 Bullemer ..... G05B 23/0272 340/506
8,443,294 B2 * 5/2013 Skidmore ..... A61M 16/0051 715/764
8,947,437 B2 * 2/2015 Garr ..... G06T 11/206 345/440
9,336,670 B2 * 5/2016 Jones, Jr. ..... G08B 13/19695
(Continued)

*Primary Examiner* — Adnan Aziz
(74) *Attorney, Agent, or Firm* — Todd R. Fronek; Larkin Hoffman Daly & Lindgren, Ltd.

(57) ABSTRACT

A facility monitoring system connects to a plurality of monitoring devices positioned throughout a facility. Each of the plurality of monitoring devices is coupled with a monitoring station, wherein the monitoring station is configured to generate a configuration of a display having a plurality of frames. Each frame displays information simultaneously wherein change of information in one frame automatically alters information related to at least one of the plurality of monitoring devices in another frame.

20 Claims, 8 Drawing Sheets

(56) References Cited

U.S. PATENT DOCUMENTS

| | | | | |
|---|---|---|---|---|
| 9,355,477 | B2 * | 5/2016 | Ashley | G06T 11/206 |
| 9,513,763 | B1 * | 12/2016 | Adams | G06F 3/0481 |
| 10,025,298 | B2 * | 7/2018 | Butter | G05B 19/4184 |
| 2001/0011946 | A1 * | 8/2001 | Horon | G08B 25/14 340/525 |
| 2002/0012011 | A1 * | 1/2002 | Roytman | H04L 41/069 715/736 |
| 2004/0098474 | A1 * | 5/2004 | Galou | H04L 41/0806 709/223 |
| 2005/0163345 | A1 * | 7/2005 | van den Bergen | G08B 13/19682 382/103 |
| 2006/0085758 | A1 * | 4/2006 | Backus | G06F 3/011 715/772 |
| 2007/0008099 | A1 * | 1/2007 | Kimmel | A62C 99/00 340/506 |
| 2007/0208438 | A1 * | 9/2007 | El-Mankabady | G05B 15/02 700/83 |
| 2008/0300698 | A1 * | 12/2008 | Havekost | G06F 9/4488 700/83 |
| 2009/0046147 | A1 * | 2/2009 | Henson | G08B 13/19604 348/143 |
| 2009/0057426 | A1 * | 3/2009 | Sullivan | G05B 19/0421 236/51 |
| 2009/0307255 | A1 * | 12/2009 | Park | G06Q 10/10 |
| 2010/0030883 | A1 * | 2/2010 | Kiefer | H04L 41/00 709/223 |
| 2012/0093477 | A1 * | 4/2012 | M | G08B 13/19671 386/230 |
| 2014/0282195 | A1 * | 9/2014 | Nixon | G05B 23/0216 715/771 |

* cited by examiner

MULTI-FRAME DISPLAY FOR A FIRE PROTECTION AND SECURITY MONITORING SYSTEM

BACKGROUND

The present disclosure relates to computerized systems for monitoring a facility such as a building or complex of several buildings, and more particularly to monitoring systems in which a central station receives inputs from several control panels, each control panel in turn supporting remote sensing devices such as smoke detectors, flow sensors and heat sensors distributed throughout the facility.

For safety and security, indoor facilities of any size can be equipped with monitoring systems that employ detectors distributed throughout the facility and a central monitoring station coupled to the detectors to receive messages. Each system can include a variety of types of detectors, e.g., smoke detectors, ion detectors and heat detectors to sense fire, flow detectors, motion detectors, and security detectors that recognize unauthorized tampering with doors or other entry points. Typically, a series of detectors are coupled in a circuit supported by a control panel, and control panels usually are capable of supporting several circuits of sensing devices.

In larger facilities, several control panels are coupled to a single central monitoring station, perhaps overseeing hundreds of detectors. While the number of detectors involved by itself increases the complexity of such larger systems, a major contributing factor is the lack of uniformity if different types of control panels are involved, particularly if the panels are supplied by different manufacturers. While key information about devices, e.g., type, location, nature of a fault or alarm indication, is common among different types of panels, the arrangement and textual representation of such information varies among panels, adding complexity and difficulty which may adversely affect an operator's response in the critical minutes immediately following an alarm, reported fault condition or other alert.

In connection with some monitoring systems, hardware converters (semiconductor chips) have been developed to translate information from different types of panels, then provide the translated information to the central monitoring station. While these devices have enhanced uniformity somewhat, they are costly and lack the power to convert all of the key information.

Along with the lack of uniformity in messages when several control panels are involved, a further difficulty of systems is the lack of flexibility to tailor written messages associated with reported alarm conditions and fault conditions.

Many present day monitoring systems include graphics capabilities for displaying an image of the monitored facility, e.g., blueprints, site maps, floor plans and similar facility representations. Providing such images in conjunction with alarm or fault reports can assist the operator in more rapidly and accurately determining the appropriate response. At the same time there is a need for visual images that more clearly direct an operator to the source of trouble and more readily suggest the appropriate response. Further, previous systems lack sufficient flexibility in adjusting images when devices are added to the system, or when locations of devices presently in the system are changed.

SUMMARY

A facility monitoring system connects to a plurality of monitoring devices positioned throughout a facility. Each of the plurality of monitoring devices is coupled with a monitoring station, wherein the monitoring station is configured to generate a configuration of a display having a plurality of frames. Each frame displays information simultaneously wherein change of information in one frame automatically alters information related to at least one of the plurality of monitoring devices in another frame.

BRIEF DESCRIPTION OF THE DRAWINGS

For a further appreciation of the above and other features and advantages, reference is made to the detailed description and to the drawings, in which.

DETAILED DESCRIPTION

Figure 1:
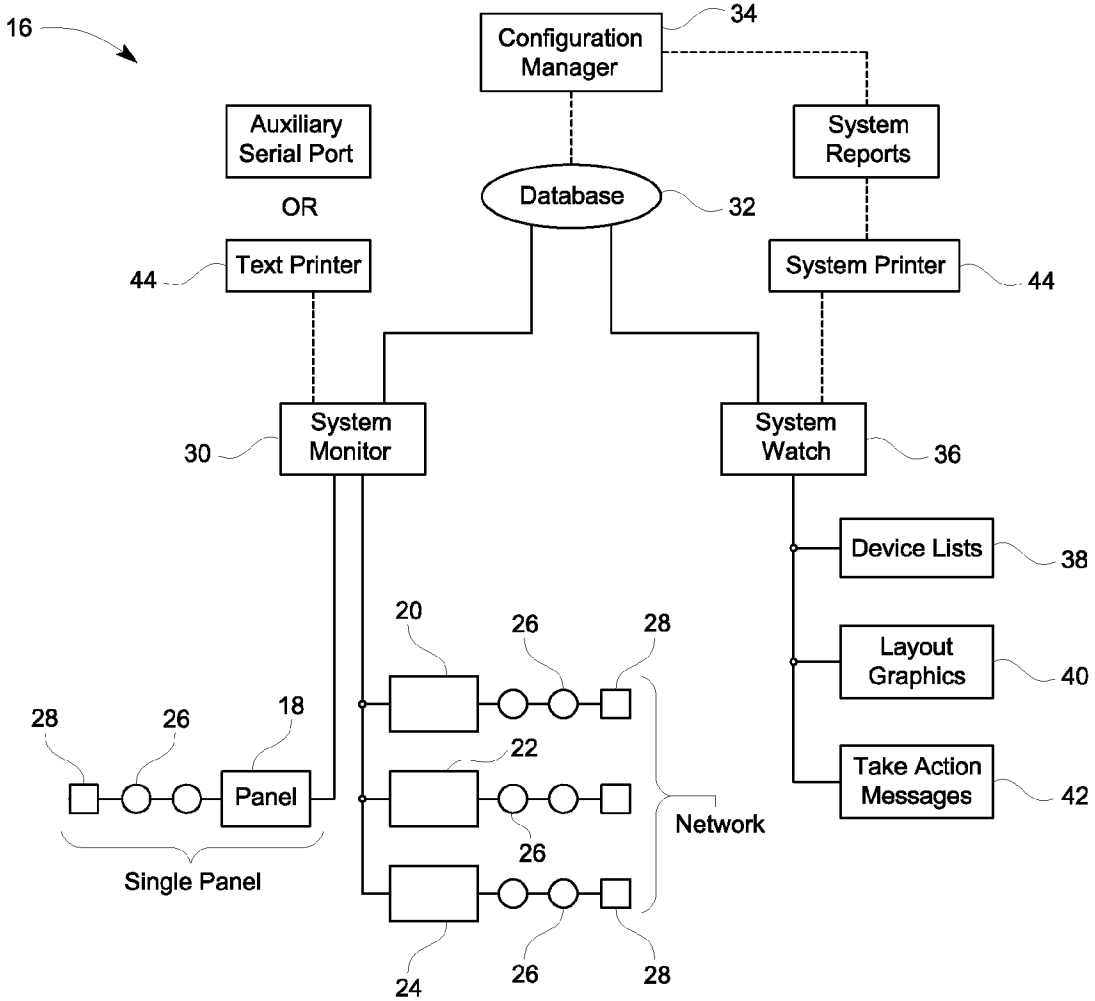
FIG. 1 is a schematic diagram of an architecture of a facility monitoring system.

This disclosure relates to U.S. Pat. Nos. 6,229,429 and 6,369,695, the contents of which are hereby incorporated by reference in their entirety. Turning now to the drawings, there is shown in FIG. 1 a system 16 for monitoring a building, complex of buildings or other facility for fire protection and other security. This figure illustrates both hardware and software (computer program) components of the system, which includes a central monitoring station and several panels and associated devices communicatively coupled (i.e., through wired and/or wireless communication) to the monitoring station. The station can support a single control panel as indicated at 18, or a series of control panels at 20, 22 and 24. Each of panels 18-24 is shown as supporting a single circuit of devices including two detectors 26 and a pull station 28. Each detector 26, in one embodiment, is equipped with a suitable sensor for sensing environmental conditions (e.g., fluid flow, temperature, objects, smoke) at a particular area. To that end, each detector 26 is operable in one of a plurality of different states (e.g., normal, fault/trouble, alarm). In practice, individual control panels can support multiple circuits (e.g., up to 32 circuits), and each circuit can include multiple devices.

Each control panel receives information from each of the devices on its circuit or circuits, and provides that information to the monitoring station, more particularly to a system monitor program 30 contained in a central processing unit (CPU). System monitor program 30 is coupled to a database 32, a configuration manager program 34 that permits certain customizing of the system, and a system watch program 36 that generates information usable to a system operator, including device lists 38, graphics 40 and action messages 42. One or more printers 44 are coupled to the system to generate reports.

Figure 2:
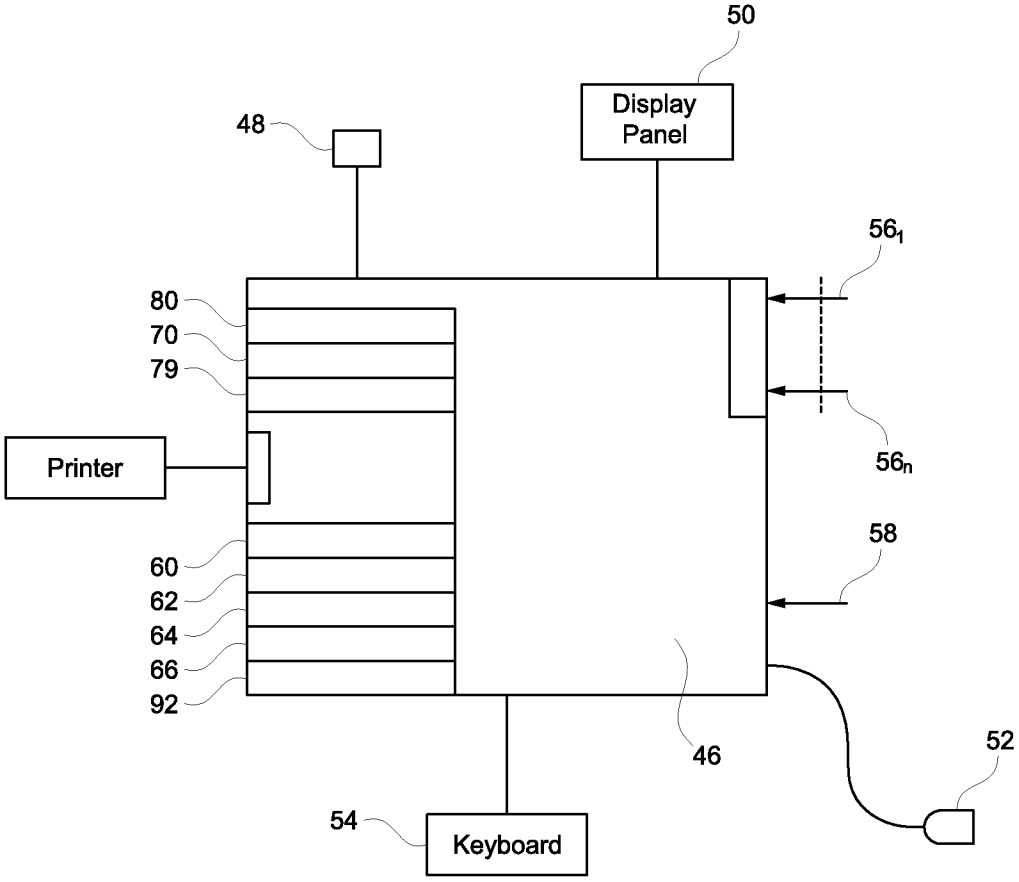
FIG. 2 is a schematic diagram of hardware components of the system of FIG. 1.

The CPU is shown in FIG. 2, indicated at 46. Hardware components in addition to printer 44 include an optional control relay 48, a video display terminal 50 for showing text and graphics, a cursor control 52, and a keyboard 54 primarily for entering textual data. In some versions of the system, a cursor also can be controlled from the keyboard.

In one embodiment of the system, video display terminal 50 is provided in the form of a "touch panel" that presents the option for users to enter a variety of instructions by applying pressure to specified regions on the face of the displayed image. This takes the place of keyboard entry, in some cases to the point where a keyboard is not required. In another embodiment, terminal 50 is a tablet or other portable computing device. In a further embodiment, multiple display terminals 50 can be coupled with the CPU 46 and connected through a suitable network connection such as Ethernet, wireless fidelity or other suitable communication network connection.

Inputs from panels such as 18-24 are indicated by arrows $\mathbf{56}_1$ through $\mathbf{56}_n$. An arrow 58 indicates other inputs to the CPU from a disk drive, network, or other source of data, e.g., a third party website, a building floor plan or site map to be stored in CPU 46 for later visual display.

The internal memory of CPU 46 can be conveniently considered to include separately identifiable segments for storing different types of information. These include a text segment 60 and a graphics segment 62, both of which contain "pre-stored" data. The information in text segment 60 is categorized, in the sense that it is sorted as to several types, e.g., as follows: control panel identification; device address; description of device location; device type; device state; time; zone; and group.

The panel is sometimes identified as a "node." The device address identifies the particular circuit and the location of the device along the circuit, for example "ckt 17 dev 15." The description of location locates the device with respect to the facility, e.g., "conference room A." The device type record can identify types of detectors such as "smoke detector," and also identifies "modules" that are not detectors but rather control input devices, such as a manual pull station or a water flow switch.

The device state category identifies three states with respect to detectors: a standby state indicating normal operation with no unusual condition detected; a "fault" or "trouble" state indicating that the detector may be disconnected or otherwise is not properly functioning; and an alarm state indicating the alarm condition, e.g., the sensing of heat by a heat detector. Finally, the "zone" and "group" categories relate to an option whereby an operator can associate several detectors or other devices, for example to associate a specific action instruction with a particular set of devices located in a designated section of a building. In some embodiments, the device can push the state to the database 32, which is then capable of updating the state associated with a particular device within the database 32 and notify (e.g., a push notification) the system monitor program 30. As a result, displays coupled with the system monitor program 30 can be automatically updated as will be discussed in more detail below.

Within each category are the specific items, e.g., entries such as "smoke detector, pull station, flow center and tamper switch" in the device type category. A user can enter additional types of devices that are not already contained in text segment 60.

Graphics segment 62 includes graphic image information of several types, including site maps, floor plans, and device image information, used to generate facility images visible on display panel 50. In particular, each of the facility images is composed of a site map or floor plan that provides a fixed (but with zoom-in and zoom-out capability) image, and one or more device images selectively positionable on the background image as is later explained. In one embodiment, images are stored in vector-based formats, which allows for considerably enhanced image detail as a device image is enlarged using the zoom-in feature. As an alternative, pixel based icons can be used to represent detectors and other devices in the composite facility image.

Likewise, the vector based formats are advantageously used in storing and generating the floor plan and site map background images, with zoom-in views of floor sectors or individual rooms exhibiting more detail.

A control panel memory segment 64 stores information provided to CPU 46 by each control panel pertaining to its devices. Data entered by an operator, for example using keyboard 54, is stored to an operator input segment 66.

CPU 46 includes a look-up table or other suitable associative component for comparing prestored data in segments 60 with data received from the control panels and stored to control panel segment 64.

When a new detector or other device is added to a circuit of one of panels 18-24, information about the device (type, location, address, etc.) is entered into the control panel, and in system 16 thus also is provided to control panel segment 64 of the memory. Further, after matching and categorizing as previously described, information regarding the new device is stored to a new device segment 80 of the memory. Devices that are "new," in the sense of not yet being represented by a device image on at least one of the composite facility images, can be maintained in a list that can be displayed on video display panel 50. The listed devices can be identified by type, panel and address.

In one embodiment, a floor plan image can be used to display device images and the location of the device within the floor plan. The device image further can be "dragged" using the cursor control (mouse) to a location on the background image that most closely represents the actual location of the associated device in the facility.

Thus and in accordance with the present disclosure, device images are easily selectively positioned on facility floor plans, site maps and other background images, to accurately depict the locations of the corresponding devices throughout the facility. Images are easily added and deleted to update each facility image to account for added and removed devices. To better insure that the facility images remain current, the addition of new devices generates a list that serves as a reminder of devices not yet depicted in composite facility images. Further, the system can receive information from different types of control panels, assimilate and categorize the information, and thus present the information to the system user in a standard format that facilitates recognition of emergency or fault conditions and promotes an appropriate response.

One feature of the present system resides in the manner in which graphic information is related to textual information in general, and matched, categorized information in particular. According to one approach in using system 16, different device states are represented by different colors in conjunction with video display terminal 50. A particular device (e.g., a photo detector) in a particular state (alarm) is assigned the color red for consistency with the alarm state. A device in the trouble or fault state is assigned the color yellow, and in connection with the normal or standby state is assigned the color green. As a result, devices in composite facility images (e.g., floor plans), as discussed below, will appear green in the normal state, yellow in the fault state and red in the alarm state. The colors (and/or other indicators) can be used to update an associated display in multiple frames (or locations) depending upon a particular configuration of the display, as will be discussed below.

Additional display options, not illustrated, involve characteristics other than color. For example, device images can be configured for a periodically interrupted display in the composite image, producing a "flashing" effect when in the alarm state, or if desired when in the fault state as well. According to another option the shape of the device image can appear to vary from one state to another, by selecting the normal shape of the device to represent the normal state, and by selecting an image of a "broken" device, for example separate parts of a device apart from one another to indicate a breaking or tearing apart to indicate the fault state. A further option involves a combination in which a fault condition is shown by the periodically alternating display of the "normal" device image and the "broken" device image, which if properly timed exhibits the effect of animation.

Figure 3:
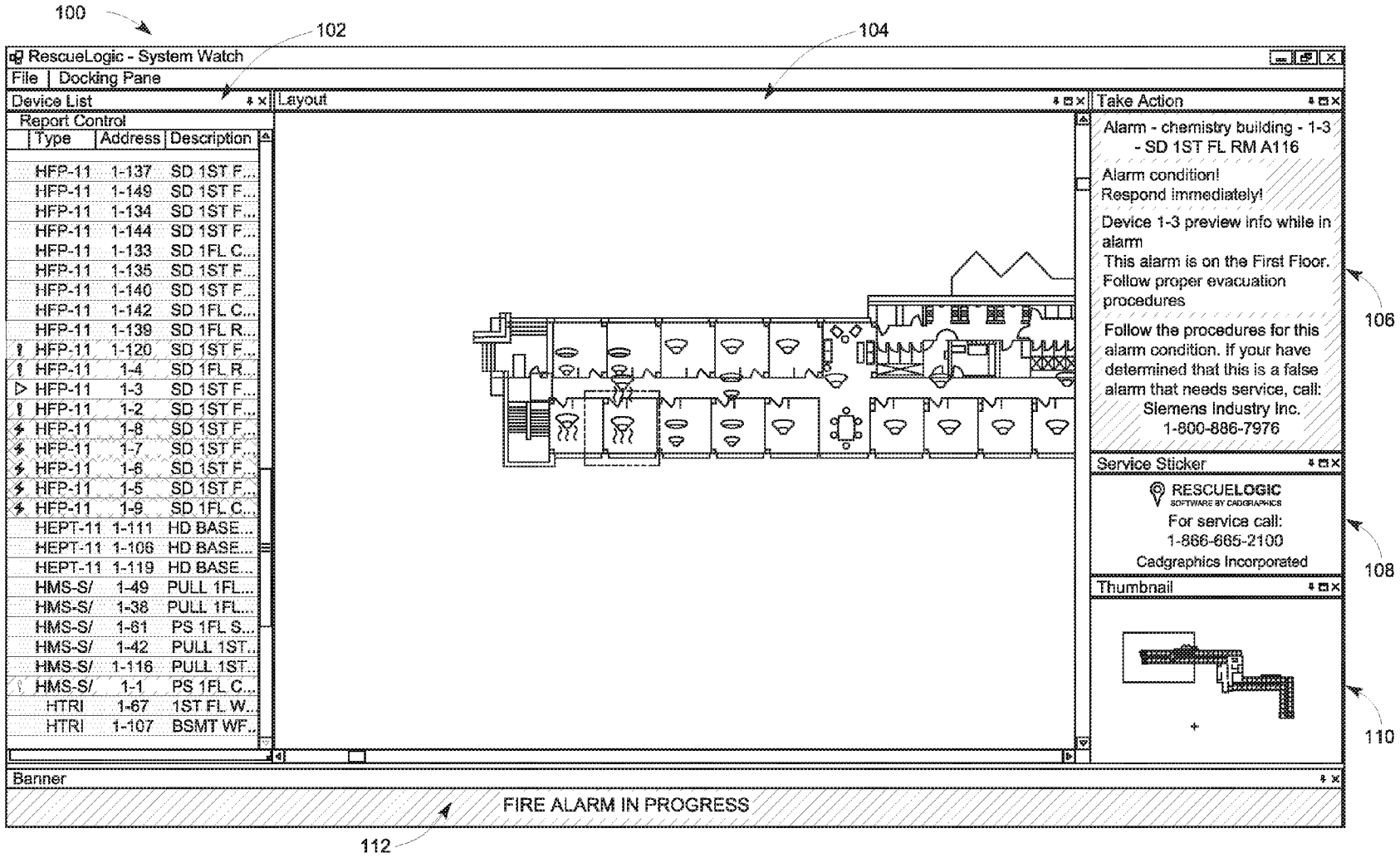
FIG. 3 is a video display representation illustrating a first configuration of a multi-frame display of the system of FIG. 1.

FIG. 3 illustrates a multi-frame configuration 100 for the video display terminal 50. The left hand side of the configuration 100 illustrates a device frame 102 that renders a list of a portion of the information stored in master list segment 70 and can be used to select a particular device as a current device. Configuration 100 further includes a layout frame 104, an instruction frame 106, a service sticker frame 108, a thumbnail frame 110 and a banner frame 112. Each of the frames 102-112 are displayed simultaneously, with the ability to remain static with respect to changes in other frames or dynamically updated as desired. Configuration 100 is operating in an administrative mode, wherein each frame 102-112 can be selected and deselected by an administrator. Additionally, the administrator can move, resize and pin various frames to the configuration 100. Moreover, within the administrator mode, each frame 102-112 is provided with title control captions indicating content for the frame.

In some instances, data displayed within one frame can be automatically updated in other frames based on the current selected device. In other instances, data displayed within frames can be static. In any event, configuration 100 provides an interface that can facilitate a rapid and appropriate response to emergency conditions, conveying information not as readily ascertainable from textual warnings. For example, a row of red detector images within device frame 102 and along a floor plan image within layout frame 104 can immediately convey information regarding how smoke from a fire is spreading down a hallway. A row of yellow devices within device frame 102 may indicate an open circuit. In one embodiment, updating selection of the current device involves directly accessing database 32 to update information displayed within the configuration 100.

The frame 102 further includes an indicator (herein shown as an arrow indicating the "Type: HFP-11, Address 1-3" device is selected) that indicates a current device for the configuration 100. In one embodiment, the frame 102 in FIG. 3 can be automatically switched if necessary to display only the active devices, in response to receipt of a new active indication from any of the control panels. Thus, as soon as a potential emergency arises, the background "noise" contributed by devices in the standby state is removed, to more readily draw the user's attention to the active devices. Frame 102 also includes a title "Report Control", with column headers "Type", "Address" and "Description". Each of these column headers can be selected to sort the list in frame 102 as desired. The column headings represent most of the categories previously discussed, while the horizontal rows are associated with the different devices in the system.

In a multicolored display embodiment, some rows provide a red background for the text, thus providing an indication of state in addition to the word "alarm" in each row under the appropriate heading. In addition, some rows are colored yellow to indicate the fault or troubled condition, corresponding to the words "missing" and "fault." Finally, some rows are colored green to indicate the standby or normal condition. For example, referring to frame 102, entries without an icon in a leftmost side of the entry can indicate green (e.g., standby or normal), entries with an exclamation point ("!") can be colored red to indicate an alarm condition, whereas those with a ("Z") can be colored yellow to indicate a missing or fault condition. Depending on the device selected in frame 102, a color for frames 106 and 112 can be automatically updated accordingly, along with other messages as desired.

Layout frame 104 illustrates a floor plan image having a color-coded box surrounding the current device selected in device frame 102. The floor plan image within layout frame 104 can be dynamically updated based on the device selected within device frame 102. As such, when a different device is selected, the layout frame 104 is automatically updated to reflect the position of the different device within the floor plan.

Layout frame 104 also includes a zoom-in/zoom-out feature, which in one embodiment can utilize a multi-contact zoom feature for a touch screen. With this feature, a user can touch the screen at two points (e.g., using two fingers). In order to zoom out on the floor plan image displayed in layout frame 104, the user can drag the two points together. As such, the floor plan image within layout frame 104 will be reduced, showing more of the overall floor plan. Alternatively, in order to zoom in on the floor plan image displayed in layout frame 104, the user can drag the two points apart. As such, the floor plan image within layout frame 104 will be enlarged, thus illustrating only a particular sector of the overall floor plan. In one embodiment, the zoom-in/zoom-out feature for layout frame 104 is updated completely independent of at least one other frame such that, when layout frame 104 changes, the at least one other frame remains static.

In another embodiment, in conjunction with the layout frame 104, the thumbnail frame 110 can be dynamically updated to illustrate an overall floor plan as well as provide an indication of a section of the floor plan (e.g., a box) depicted within the layout frame 104. Upon using either the zoom-in or zoom-out features discussed above, the thumbnail feature 110 can be dynamically updated to reflect the section displayed within the layout frame 104. As such, touch points external to the thumbnail frame 110 directly update the depicted floor plan within the thumbnail frame 110.

Instruction frame 106 can be dynamically updated in concert with a state of the current device or based on some other factor. In particular, the instruction frame 106 is designed to indicate particular instructions about what a user should do given a current device status or other system condition. For example, the instruction frame 106 can indicate a location for the alarm, including building, floor, etc.

and/or other information as desired. While in the administrative mode, the instruction frame 106 can be edited directly within the displayed frame. Such editing can automatically update the database entry associated with the text in the instruction frame 106. The service sticker frame 108 can be a static frame that remains constant independent of information being displayed in the other frames. As illustrated, the service sticker frame 108 includes information that is helpful in servicing the system software. Banner frame 112 is an ancillary frame that can be used to provide various alerts and/or prominent information as desired.

Figure 4:
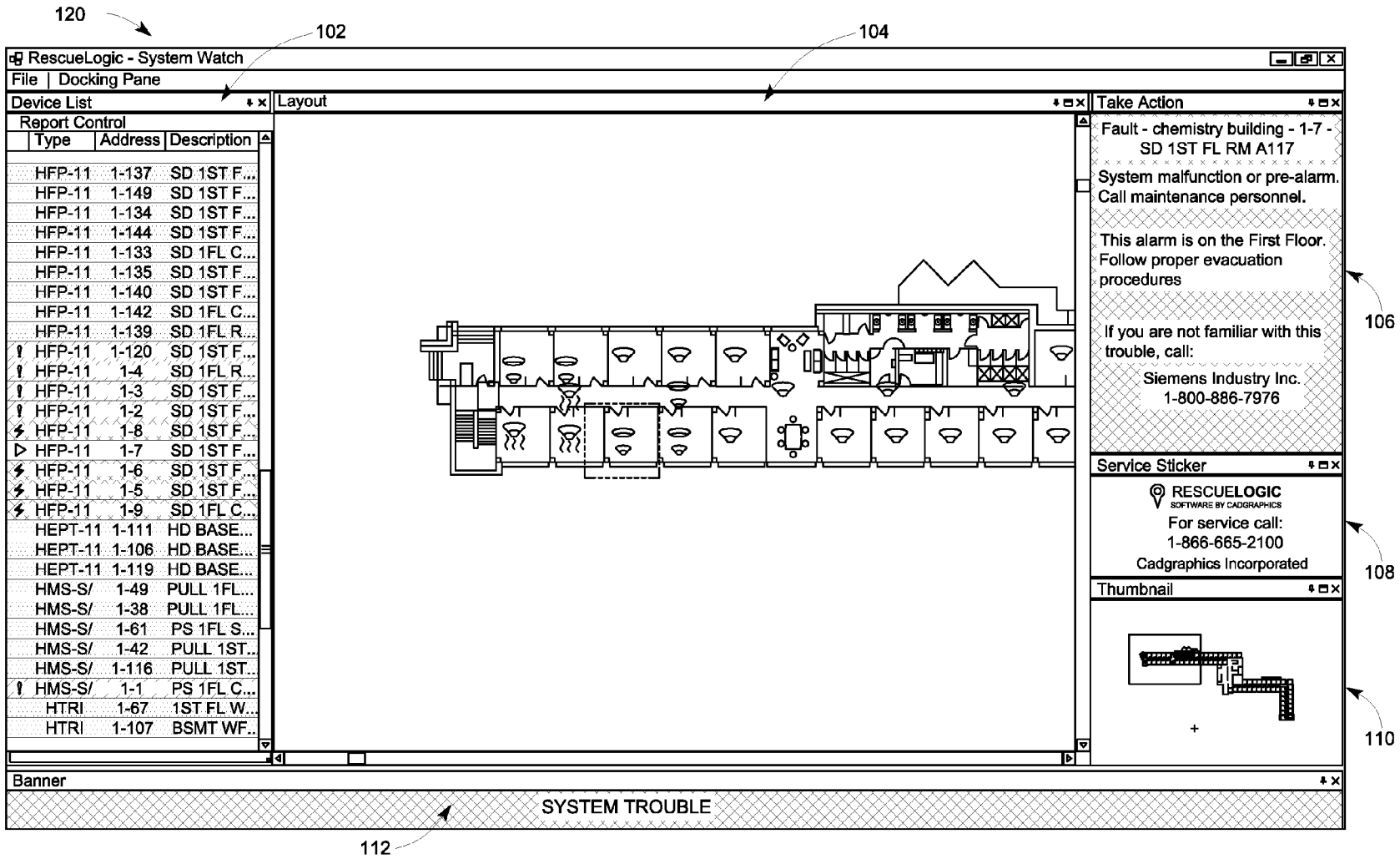
FIG. 4 is a video display representation illustrating a second configuration of a multi-frame display of the system of FIG. 1.

FIG. 4 illustrates a configuration 120 similar to configuration 100 of FIG. 3. However, FIG. 4 is in a user mode, rather than the administrative mode. As such, the title control captions have been removed. Multiple users can identify particular configurations for a single facility. For example, one user may wish to have an additional frame as part of a configuration. In comparison to configuration 100, a different device within frame 102 has been selected, which is adjacent to the device selected in FIG. 3. As a result of the new selection, other frames within the configuration 120 are dynamically and automatically updated. For example, the layout frame 104 is updated to move a target box around the current device, as well as change color. The status of instruction frame 106 and banner frame 112 are further updated, which correspond to the selected current device. Since the floor plan image in layout frame 104 has not changed, thumbnail frame 110 is not altered. Additionally, service sticker frame 108 remains unchanged.

Figure 5:
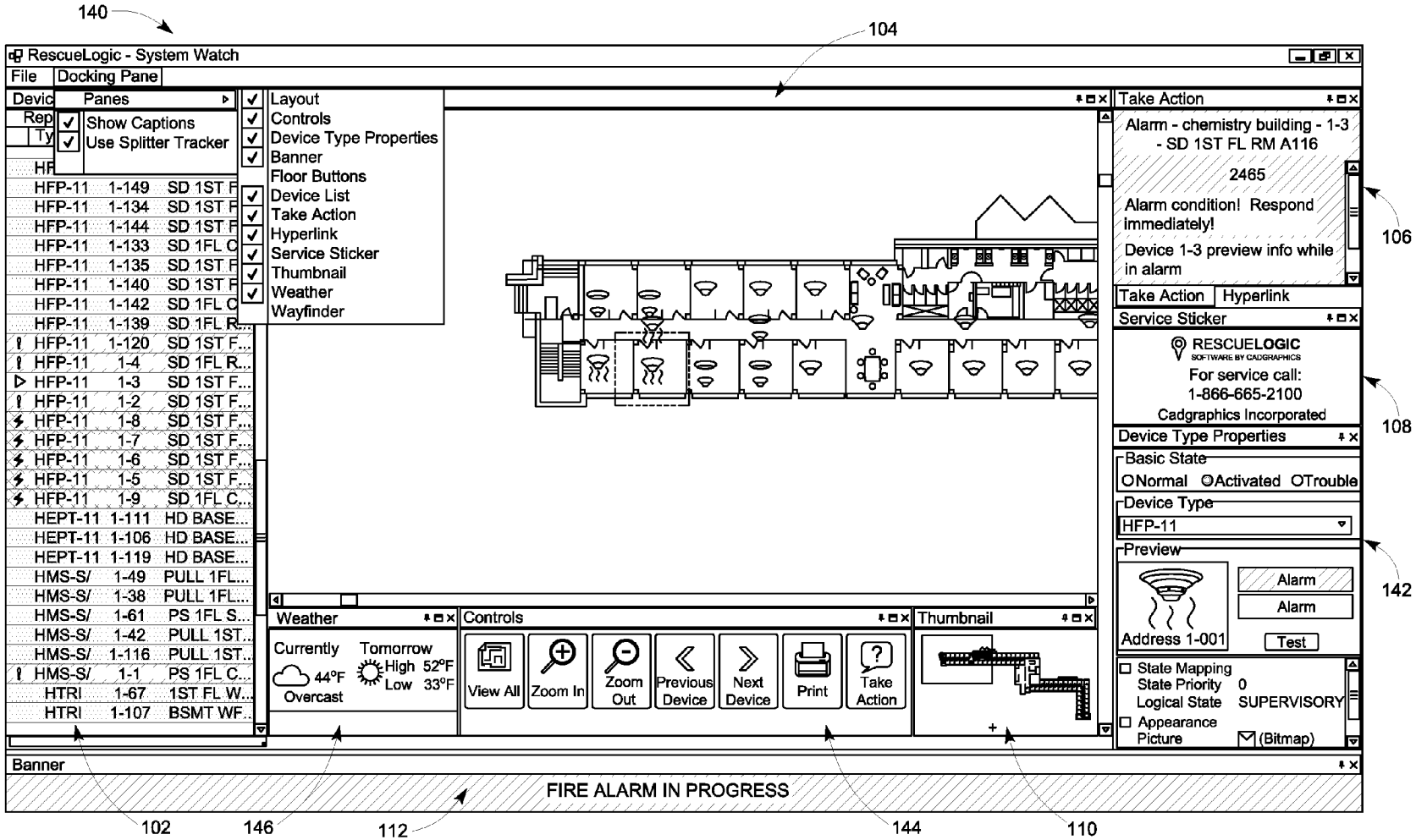
FIG. 5 is a video display representation illustrating a third configuration of a multi-frame display of the system of FIG. 1.

FIG. 5 illustrates yet an alternative configuration 140, which includes frames 102-112 as discussed above with respect to FIG. 3. In addition, configuration 140 further includes a detailed device frame 142. The information in detailed device frame 142 includes an image of the device, a status indicator and other detailed information useful to the user. Additionally, a touch panel frame 144 features regions or "buttons" that can be pressed by an operator for a desired result. For example, the "previous device" and "next device" buttons are pressed to highlight the preceding or next device. The "view all" button functions to view all devices. Yet a further frame 146 displays information from a third party source, such as the weather. This frame 146 can be dynamically updated based on information from the third party source, independent of any updating of other frames in the configuration 140.

Figure 6:
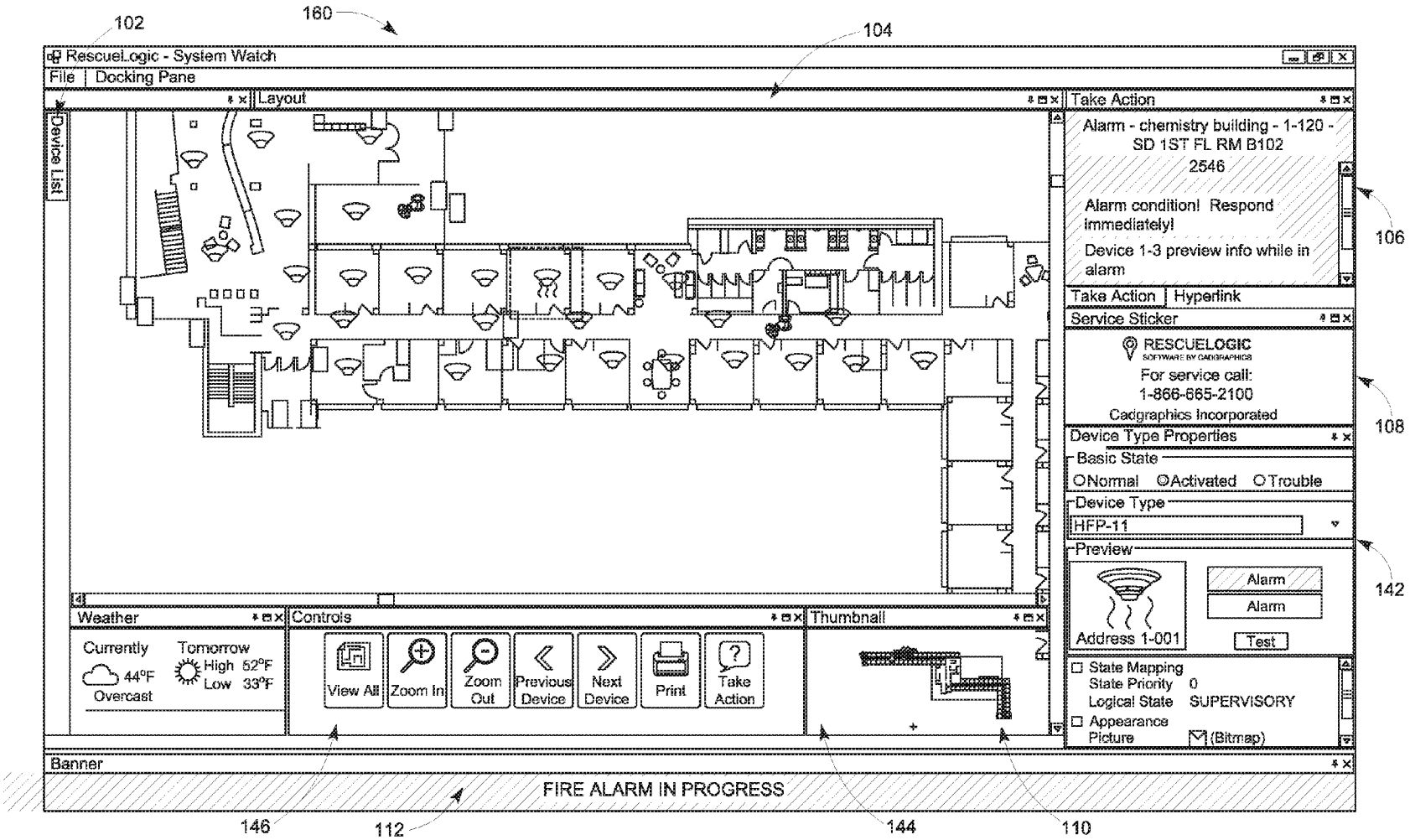
FIG. 6 is a video display representation illustrating a fourth configuration of a multi-frame display of the system of FIG. 1.

FIG. 6 illustrates an alternative configuration 160, similar to configuration 140, wherein device frame 102 is pinned to the left hand side of the configuration 160 and minimized to a tab 162. As such, a size of a remainder of the frames are adjusted so as to fill up the screen size of configuration 160. For example, layout frame 104 has been enlarged compared to its size in configuration 140 of FIG. 5. Moreover, third party frame 146 has shifted left such that it is adjacent to an edge of the configuration 160. If a user clicks on tab 162, the device frame 102 will return to its original location, wherein the remaining frames will be adjusted to accommodate the device frame 102. Additionally, in comparison with configuration 140 of FIG. 5, a different device has been selected such that the layout frame 104, instruction frame 106, thumbnail frame 110 and detailed device frame 142 have been automatically adjusted to reflect the new device.

Figure 7:
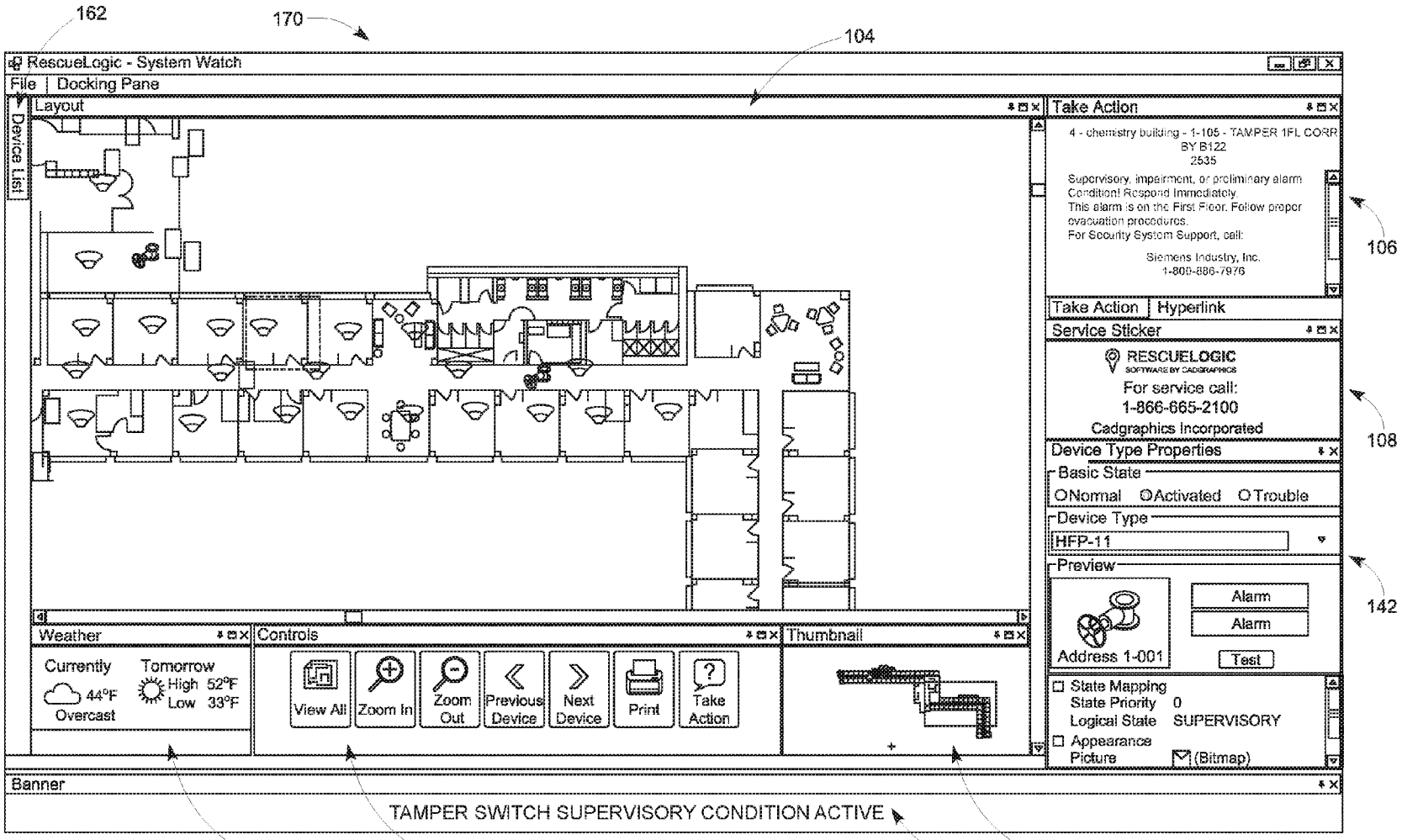
FIG. 7 is a video display representation illustrating a fifth configuration of a multi-frame display of the system of FIG. 1.

FIG. 7 is another configuration 170, in which the "next device" button from the touch panel frame 144 was pressed. In response, the layout frame 104, instruction frame 106, thumbnail frame 110 and detailed device frame 142 have automatically been updated to reflect information associated with the next device.

Figure 8:
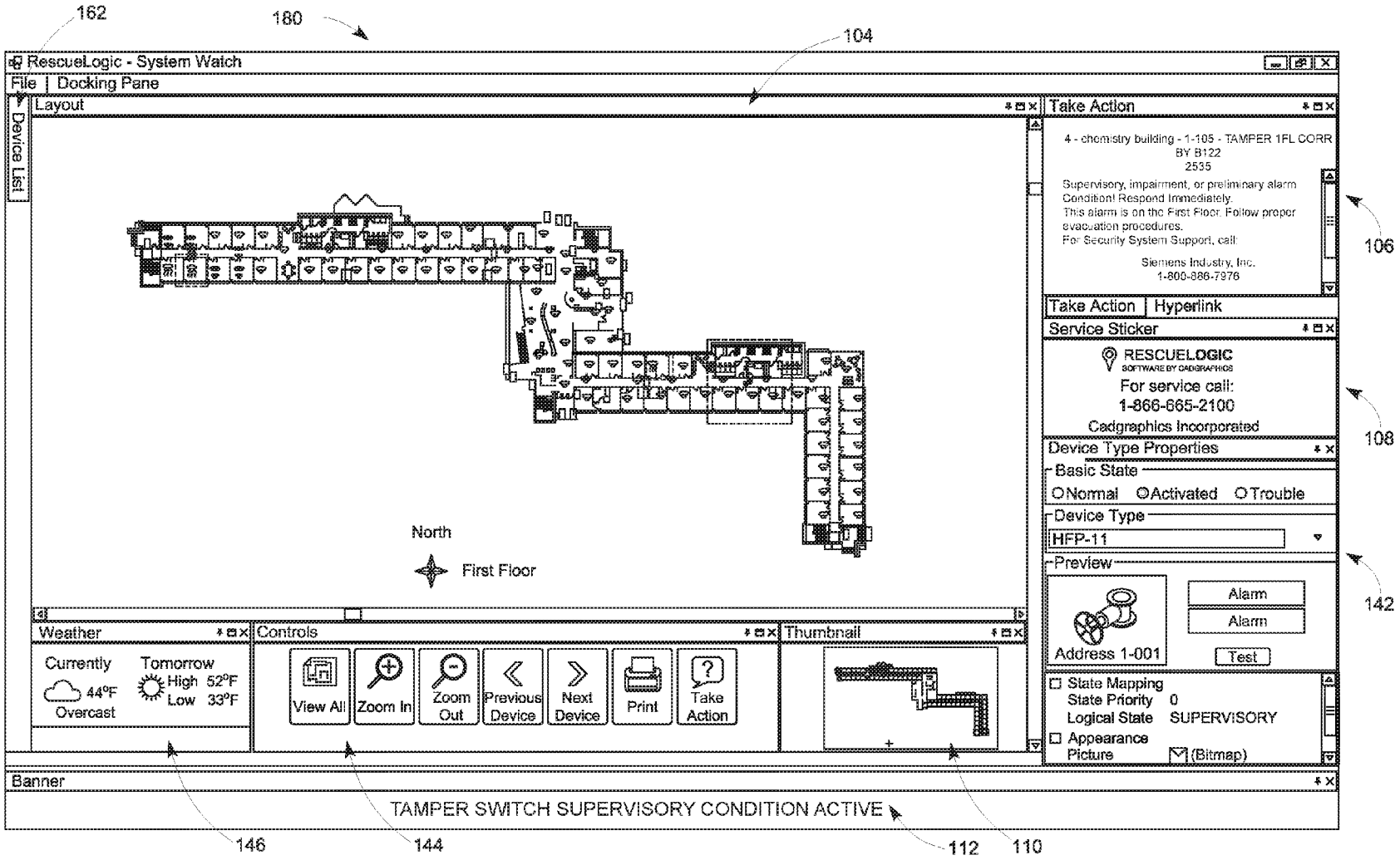
FIG. 8 is a video display representation illustrating a sixth configuration of a multi-frame display of the system of FIG. 1.

FIG. 8 is yet another configuration 180, after the "view all" button from the touch panel frame 144. In response to pressing the view all button, the layout frame 104 and thumbnail frame 110 are automatically updated to reflect an entirety of the floor plan.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A monitoring system for a facility, comprising:

a monitoring station, wherein the monitoring station includes an administrative mode and multiple user modes, the administrative mode providing more functionality than the user modes;

a plurality of monitoring devices positioned throughout the facility, each of the plurality of monitoring devices coupled with the monitoring station and operable in a plurality of different states, each state associated with a particular display characteristic independent of the mode from the monitoring station;

a database accessible by the monitoring station and comprising a plurality of records for each of the plurality of monitoring devices; and a display coupled with the monitoring system, wherein the monitoring station is configured to generate a configuration viewable on the display having a plurality of frames including a device frame, a layout frame, and at least one of an instruction frame, a thumbnail frame and a banner frame, each frame displaying information from the plurality of records simultaneously, wherein change of information in the device frame automatically alters information related to the plurality of monitoring devices in the layout frame, wherein the configuration allows selection of a device within the device frame and wherein the layout frame is automatically updated with an indication of a physical location of the device in relation to other devices and within the facility based on the selection and wherein the layout frame and the at least one of the instruction frame, the thumbnail frame and the banner frame is automatically updated with the particular display characteristic based on a change in the state of the device.

2. The system of claim 1, wherein the layout frame includes a floor plan image and wherein a user can zoom in and out on the floor plan image by using multiple contact points.

3. The system of claim 1, wherein at least one of the frames of the plurality of frames is a static frame such that information change in the device frame will not change information in the static frame.

4. The system of claim 1, wherein the device frame displays information for the device, the layout frame displays a physical representation of the facility and the instruction frame displays information regarding the device.

5. The system of claim 4, wherein the configuration further includes a thumbnail frame illustrating an overall floor plan of the facility and an indication of a location of the layout frame.

6. The system of claim 1, wherein the configuration can be altered by dragging frames to another location on the configuration.

7. The system of claim 1, wherein the plurality of states include an alarm state, a normal state and a warning state.

8. The system of claim 1, wherein a change of state for one of the plurality of monitoring devices is immediately sent to the database and to the display.

9. The monitoring system of claim 1, wherein the particular display characteristic is one of a color and a periodic interruption.

10. The monitoring system of claim 1, wherein the thumbnail frame is configured to display information pertaining to a position of the layout frame relative to a floor plan of the facility.

11. A method of monitoring a facility, comprising:

connecting a monitoring station with a plurality of monitoring devices positioned throughout the facility, each of the plurality of monitoring devices operable in a plurality of different states, each state associated with a particular display characteristic, wherein the monitoring station includes an administrative mode and multiple user modes, the administrative mode providing more functionality that the user modes and the particular display characteristic being independent of the mode from the monitoring station;

accessing a database accessible by the monitoring station, the database comprising a plurality of records for each of the plurality of monitoring devices; and generating a configuration viewable on a display coupled with the monitoring system, the display having a plurality of frames including a device frame, a layout frame, and at least one of an instruction frame, a thumbnail frame and a banner frame, each frame displaying information from the plurality of records simultaneously, wherein change of information in the device frame automatically alters information related to the plurality of monitoring devices in the layout frame, wherein the configuration allows selection of a device within the device frame and wherein the layout frame is automatically updated with an indication of a physical location of the device in relation to other devices and within the facility based on the selection and wherein the layout frame and the at least one of the instruction frame, the thumbnail frame and the banner frame is automatically updated with the particular display characteristic based on a change in the state of the device.

12. The method of claim 11, wherein the layout frame includes a floor plan image and wherein a user can zoom in and out on the floor plan image by using multiple contact points.

13. The method of claim 11, wherein at least one of the frames of the plurality of frames is a static frame such that information change in the device frame will not change information in the static frame.

14. The method of claim 11, wherein the device frame displays information for the device, the layout frame displays a physical representation of the facility and the instruction frame displays information regarding the device.

15. The method of claim 14, wherein the configuration further includes a thumbnail frame illustrating an overall floor plan of the facility and an indication of a location of the layout frame.

16. The method of claim 11, wherein the configuration can be altered by dragging frames to another location on the configuration.

17. The method of claim 11, wherein the plurality of states include an alarm state, a normal state and a warning state.

18. The method of claim 11, wherein a change of state for one of the plurality of monitoring devices is immediately sent to the database and to the display.

19. The method of claim 11, wherein the particular display characteristic is one of a color and a periodic interruption.

20. The method of claim 11, wherein the thumbnail frame is configured to display information pertaining to a position of the layout frame relative to a floor plan of the facility.

* * * * *